United States Patent [19]

Deetz et al.

[11] 4,062,285

[45] Dec. 13, 1977

[54] HAMMER DRIVER CONTROLLER FOR IMPACT PRINTERS

[75] Inventors: David R. Deetz, Dallas; Roy H. Ogburn, Lewisville, both of Tex.

[73] Assignee: Xerox Corporation, Stamford, Conn.

[21] Appl. No.: 622,571

[22] Filed: Oct. 15, 1975

[51] Int. Cl.[2] ..... B41J 9/42

[52] U.S. Cl. ..... 101/93.02; 101/93.03; 101/93.48

[58] Field of Search .... 101/93.02, 93.03, 93.29–93.34, 101/93.48; 197/6.6, 6.7, 17, 49, 53–55; 335/241, 242, 277; 317/148.5

[56] References Cited

U.S. PATENT DOCUMENTS

| | | | |
|---|---|---|---|
| 3,172,353 | 3/1965 | Helms | 101/93.03 |
| 3,335,659 | 8/1967 | Schacht et al. | 101/93.02 |
| 3,507,213 | 4/1970 | Derc | 101/93.02 |
| 3,678,847 | 7/1972 | Pear et al. | 101/93.02 |
| 3,741,113 | 6/1973 | Mako et al. | 101/93.02 |
| 3,760,925 | 9/1973 | Bossi | 197/53 |

OTHER PUBLICATIONS

IBM Technical Disclosure Bulletin, J. D. Engles, vol. 1, No. 4, Dec., 1958, p. 44.

*Primary Examiner*—Edward M. Coven

[57] ABSTRACT

To obtain a substantially uniform print density while printing at high speed with a hammer-type impact printer, the hammer is electromagnetically driven in response to an energizing current which decays with a predetermined time constant from a high initial level toward a set point level which is automatically adjusted for different classes of characters so that the impact energy imparted to the hammer is regulated as a function of the character being printed. To adaptively absorb the shock forces generated by the rebounding hammer, the energizing current for the electromagnetic driver is reduced to a predetermined fraction of the set point level.

6 Claims, 5 Drawing Figures

FIG. 4
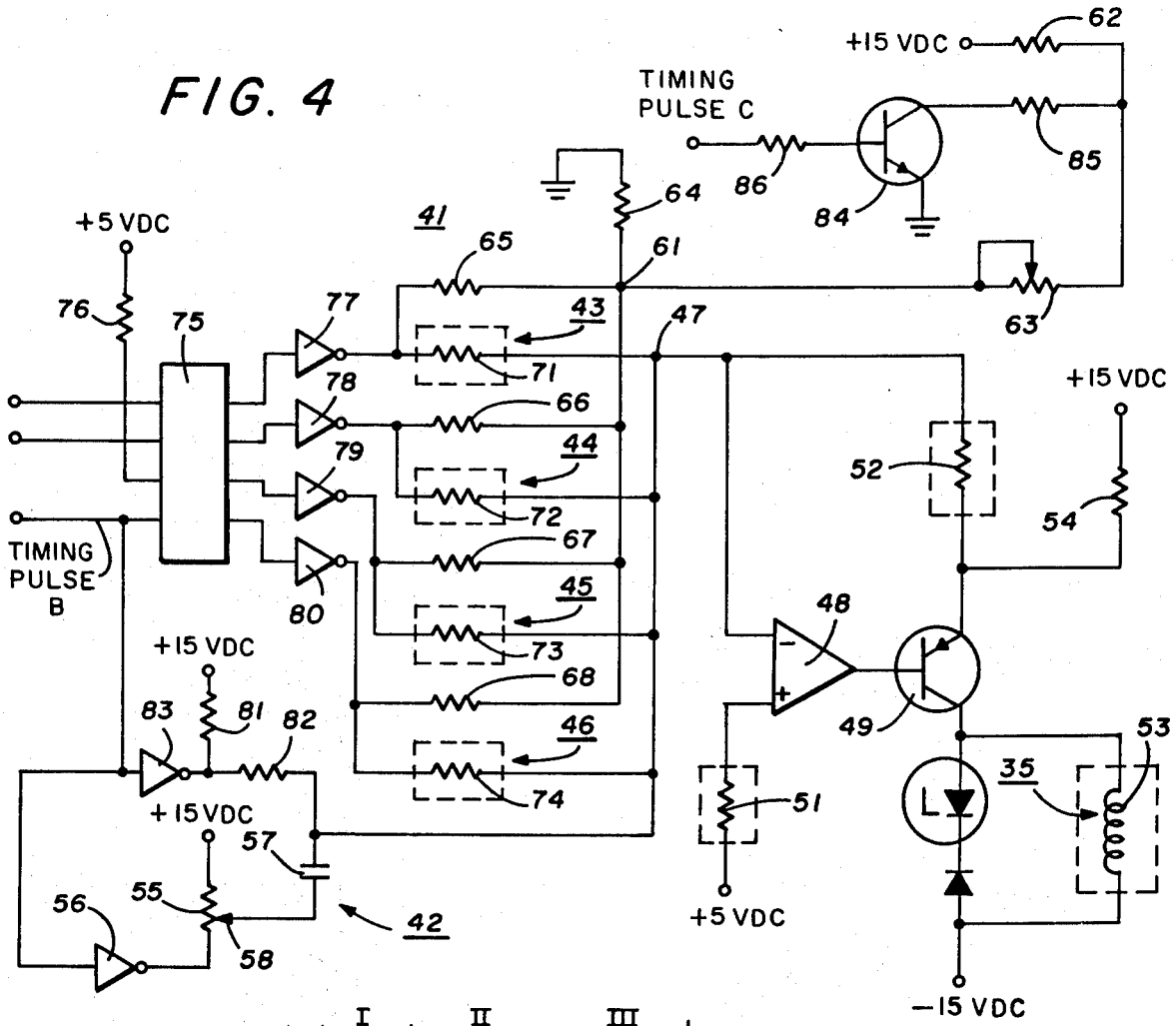
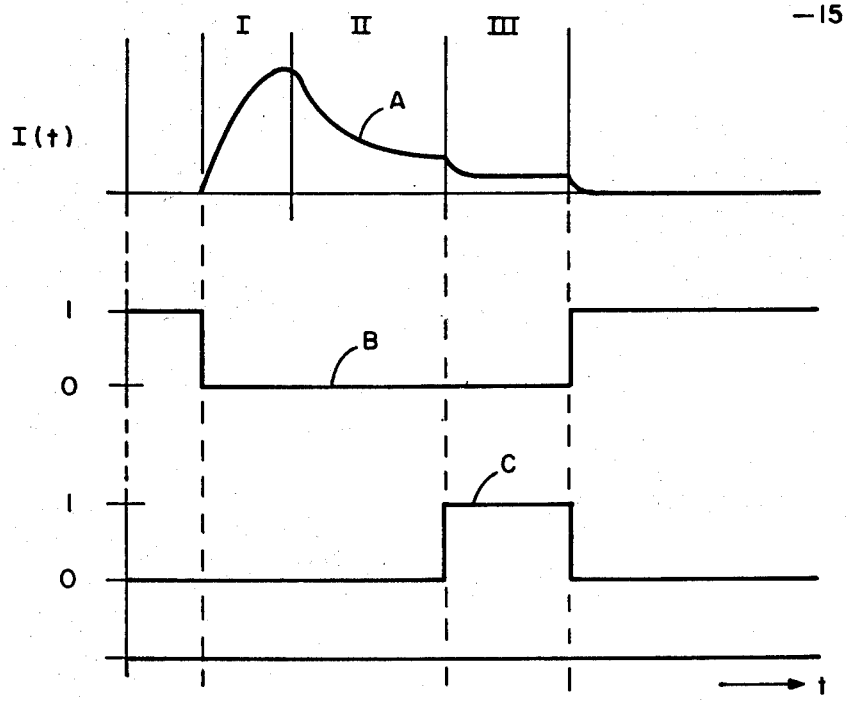
FIG. 5

HAMMER DRIVER CONTROLLER FOR IMPACT PRINTERS

BACKGROUND OF THE INVENTION

This invention relates to hammer drivers for impact printers and, more particularly, to variable energy electromagnetic drivers for the hammers of such printers.

Hammer-type impact printing mechanisms are most commonly found in computer printers and the like where printing speed, rather than print quality, is the predominant concern. However, it is known that high quality (e.g., typewriter quality) printing may be carried out with such a printing mechanism, if the hammer impact energy is varied in manner tending to compensate for the tendency of different classes of characters to print with different densities.

Unfortunately, prior variable energy hammer drivers have not been altogether successful, primarily because of the difficulty which has been experienced in attempting to hold set point hammer impact energy levels for the different classes of characters, especially when high speed printing is called for. It is believed that one of the major causes of that shortcoming is that such a driver is normally subjected to repeated applications of shock forces, especially on the return or rebound strokes of the hammer.

SUMMARY OF THE INVENTION

Accordingly, a primary aim of this invention is to provide a method and means for reducing the shock forces applied to a variable energy hammer driver for an impact printer. In other words, an object is to provide a relatively reliable and maintenance free hammer driver for high print quality impact printers.

More specifically, an object of the present invention is to provide adaptive shock absorbing methods and means for variable energy hammer drivers of the foregoing type, whereby the resistance the hammer encounters on its return or rebound stroke is automatically varied as a direct function of the energy imparted to the hammer on its forward or printing stroke. A detailed related object is to provide methods and means for adjusting a hammer driver having the above-mentioned characteristics so that normal differences in printing mechanisms and operator preferences can be accommodated.

Briefly, to realize these and other goals of this invention, an electromagnetic driver for the hammer of an impact printer includes means for controlling the energizing current applied to the driver such that the current decays in accordance with a predetermined time constant from a high initial level toward a selected one of a plurality of different set point levels which are preselected to accommodate different classes of characters. Hammer impact occurs while the energizing current is decaying toward the selected set point level. Thereafter, the energizing current is reduced to a predetermined fraction of the selected set point level to establish the shock absorbing resistance the hammer encounters on its return or rebound stroke. Provision is made for additively adjusting the set point levels to accommodate electromechanical deviations of different printing mechanisms and for proportionately adjusting those levels to accommodate preferences of different operators.

BRIEF DESCRIPTION OF THE DRAWINGS

Still further objects and advantages of the present invention will become apparent when the following detailed description is read in conjunction with the attached drawings, in which:

FIG. 4 is a schematic diagram of a controller which is provided in accordance with the present invention for the driver shown in FIG. 3; and FIG. 5 is a timing diagram for the controller shown in FIG. 4.

DETAILED DESCRIPTION OF THE ILLUSTRATED EMBODIMENT

While the invention is described in some detail hereinbelow with reference to a single embodiment, it is to be understood that there is no intent to limit it to that embodiment. On the contrary, the aim is to cover all modifications, alternatives and equivalents falling within the spirit and scope of the invention as defined by the appended claims.

Figure 1:
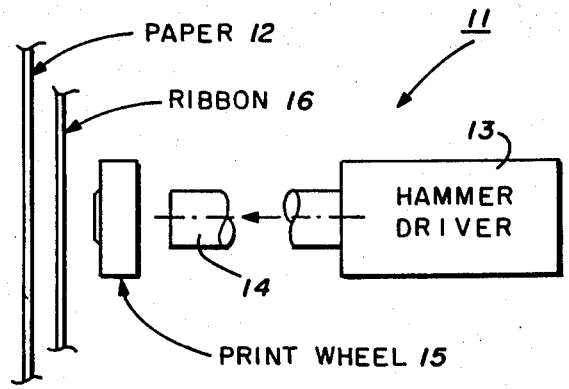
FIG. 1 is a simplified schematic view of a hammer-type impact printing mechanism with which the hammer driver controller of this invention may be advantageously utilized.

Turning now to the drawings, and at this point especially to FIG. 1, it will be seen that there is a hammer-type impact printing mechanism 11 for printing on a plain paper recording medium 12. To that end, the printing mechanism 11 comprises a driver 13 for propelling a hammer 14 forwardly, thereby urging a character on a pre-positioned print wheel 15 into engagement with an inked ribbon 16 which, in turn, strikes the paper 12 to print a replica of a character.

Figure 2:
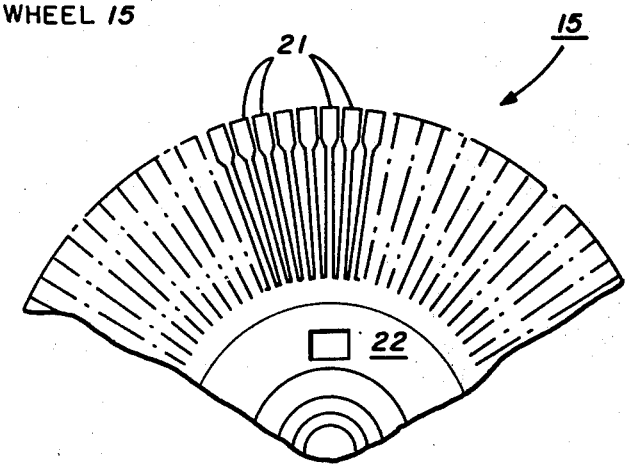
FIG. 2 is a fragmentary plan view of a print wheel for the printing mechanism shown in FIG. 1.

As shown in greater detail in FIG. 2, the print wheel 15 typically has a plurality of circumferentially distributed flexible arms 21 which radiate outwardly from a central hub 22 to carry different characters or type elements. The wheel 15 is journaled (by means not shown) for rotation about an axis which passes more or less through the center of the hub 22 on a line which is nearly parallel to the longitudinal axis of the hammer 14. The characters are radially offset from the axis of rotation of the wheel 15 by a distance which is selected so that any of the characters may be brought into axial alignment with the hammer 14 by appropriately indexing the wheel 15.

In short, the exemplary printing mechanism is essentially identical to the one that is now in use in the Xerox 800 Electronic Typing System. Consequently, readers interested in further details of the printing mechanism 11 may refer to that commercially available equipment and to the published literature pertaining thereto. Additionally, reference may be had to a commonly assigned U.S. Pat. No. 3,954,163 of Andrew Gabor, which issued on May 4, 1976 on a "High Speed Printer with Intermittent Print Wheel and Carriage Movement." Hence, that patent is hereby incorporated by reference. Furthermore, to provide some helpful background, it is noted that the printing mechanism 11 includes a platen (not shown) for supporting the recording medium 12, and that the driver 13, the hammer 14, the character wheel 15, and the ribbon 16 are carried by a carriage (also not shown) which is mounted for linear movement transversely of the platen.

Figure 3:
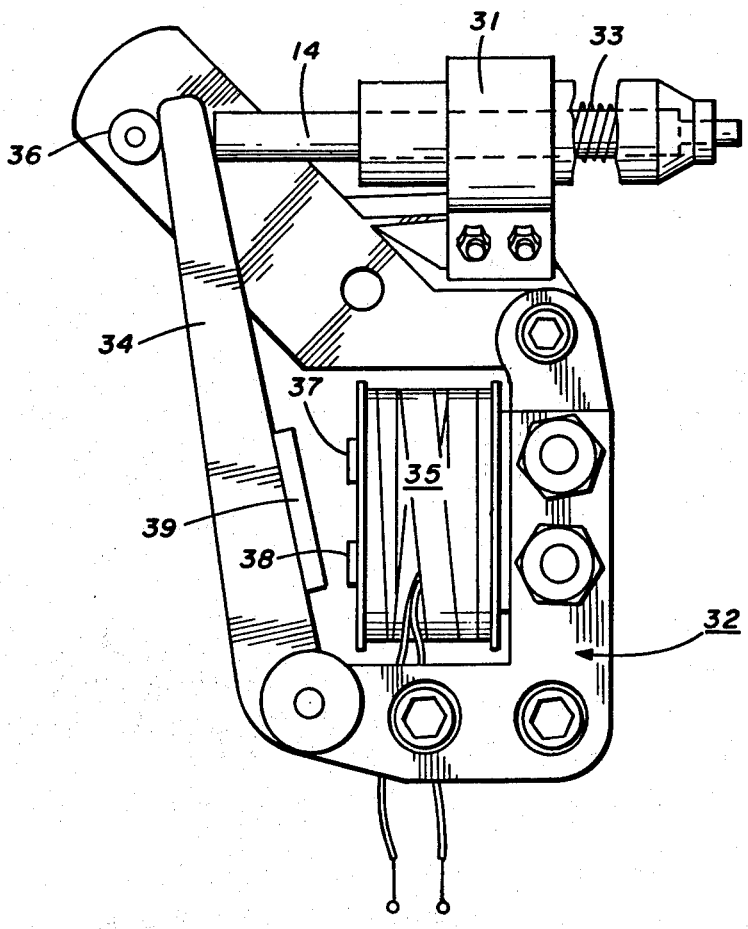
FIG. 3 is an enlarged, simplified elevational view of an electromagnetic hammer driver for the printing mechanism shown in FIG. 1.

Referring to FIG. 3, in keeping with accepted practices, the hammer 14 is slidingly guided in a sleeve 31 for reciprocating movement toward and away from the recording medium 12 (FIG. 1). The sleeve 21 is secured to a support assembly 32, and a compression spring 33 is anchored on and surrounds the hammer 14 to bottom against a reduced diameter portion of the sleeve 31 as the hammer 14 moves forwardly toward the recording medium 12.

The hammer driver 13, on the other hand, comprises an actuator arm 34 which is pivotally mounted on the support assembly 32 in position to propel the hammer 14 forwardly toward the recording medium 12 in response to the energization of an electromagnet 35. Under quiescent conditions, the bias supplied by the spring 33 maintains the hammer 14 in contact with the actuator arm 34 and urges the actuator arm 34 into engagement with a backstop 36 mounted on the support assembly 32. However, the electromagnet 35 is mounted on the support assembly 32 with its poles 37 and 38 facing a soft iron pole piece 39 carried by the actuator arm 34. Accordingly, when an energizing current is applied to the electromagnet 35, the actuator arm 34 is rotated against the bias supplied by the spring 33 to bring the pole piece 39 into engagement with the magnetic poles 37 and 38. Moreover, as the pole piece 39 approaches the poles 37 and 38 of the electromagnet 35, the actuator arm 34 propels the hammer 14 forwardly against the bias supplied by the spring 33.

Turning now to FIG. 4, in accordance with the present invention, the energizing current (I(+) in FIG. 5) for the electromagnet 35 of the hammer driver 13 is supplied in response to a print command by a controller 41 which includes means for causing that current to decay from a high initial level (I(+), region I) toward a selected one of a plurality of different set point levels (I(+), region II) and means for thereafter reducing the energizing current to a predetermined fraction of its selected set point level (I(+), region III). An impulse-like force is generated by the electromagnet 35 in response to the high initial level of the energizing current, thereby aiding in overcoming the static friction of the hammer 14 and the actuator arm 34. The terminal velocity of the actuator arm 34 (i.e., the velocity of a given point on the actuator arm 34 immediately prior to the contact of the pole piece 39 with the poles 37 and 38 of the electromagnet 35) is, however, controlled in accordance with the different set point levels to vary the hammer impact energy for different classes of character. Moreover, the resistance provided by the electromagnet 35 to absorb the shock of the rebound or return stroke of the hammer 14 is adaptively adjusted as a direct function of the impact energy imparted to the hammer 14 on its forward or print stroke.

More particularly, as illustrated, the controller 41 comprises an RC circuit 42 for supplying a current pulse or spike at the outset of each printing cycle and a plurality of level setting circuits 43–46 for selectively supplying different set point currents. The current pulse and the selected set point current are summed at a summing node 47 and then amplified by means of an operational amplifier 48 and a transistor 49 to provide the energizing current A (FIG. 5) for the electromagnet 35. To carry out the current amplification, the operational amplifier 48 has its inverting input coupled to the summing node 47, its noninverting input returned to a suitable bias voltage through a resistor 51, and its output coupled to the base of the transistor 49 which, in turn, has its emitter returned to the inverting input of the operational amplifier 48 via a feedback resistor 52 and its collector coupled in series with the coil 53 of the electromagnet 35. Furthermore, the emitter of the transistor 49 is coupled to a suitable supply source of a first polarity through a resistor 54, while the collector of the transistor 49 is coupled to another supply source of the opposite polarity through the coil 53. Accordingly, the electromagnet 35 is energized in response to the collector-emitter current drawn by the transistor 49, which, of course, is controlled by the base-emitter drive current supplied for the transistor 49 in response to the current appearing at the summing node 47.

To provide the current pulse, the RC circuit 42 includes a potentiometer 55, which is coupled between the output of an inverter 56 and a suitable supply source, and a capacitor 57, which is coupled between the slider 58 of the potentiometer 55 and the summing node 47. Under quiescent conditions, the output of the inverter 56 is held at a low ("0") logic level because a timing pulse B (FIG. 5) applied to its input is at a high ("1") logic level. However, provision (not shown) is made for maintaining the timing pulse B at a low ("0") logic level throughout each printing cycle. Hence, the output of the inverter 56 goes to a high ("1") logic level at the outset of each printing cycle, thereby causing the capacitor 57 to draw charging current from the supply source and to feed that current to the summing node 47. As will be appreciated, the charging current drawn by the capacitor 57 is initially at a relatively high level, but decays from that level in accordance with a predetermined time constant defined by the setting of the potentiometer 55, the value of the capacitor 57, and the input impedance of the operational amplifier 48. Consequently, in keeping with one of the more detailed features of this invention, the potentiometer 55 is provided so that additive adjustments may be made to the energizing current for the electromagnet 35 in order to accommodate normal electromechanical tolerances of different printing mechanisms 11. Specifically, the potentiometer 55 is preferably adjusted so that the current pulse supplied by the RC circuit 42 is sufficient to cause the hammer 14 to urge the selected character on the print wheel 15 and the ribbon 16 (FIG. 1) forwardly to just touch the recording medium 12 at zero velocity.

Accordingly, the actual impact energy transmitted by the hammer 14 to the recording medium 12 via the selected character on the print wheel 15 and the ribbon 16 is largely governed by the level setting circuit 43–46, thereby permitting the impact emergy to be closely tailored to the different classes of characters.

To establish appropriate set point current levels for the different classes of characters, the level setting circuits 43–46 are coupled in parallel between the current summing node 47 and the midpoint 61 of a voltage divider which has one arm coupled to a suitable supply source through a fixed resistor 62 and an adjustable resistor or rheostat 63 and another arm returned to ground through a second fixed resistor 64. Within the level setting circuits 43–46 there are weighting resistors 65–58 and series connected buffering resistors 71–74, whereby the set point current level supplied by each of the level setting circuits 43–46 is determined by the voltage dividing ratio of voltage divider 62–64 and the sum of the values of the weighting resistor and buffering resistor of the particular level setting circuit in question.

Accordingly, in keeping with another of the detailed features of this invention, the level setting or so-called set point currents for the different classes of characters may be proportionately adjusted to satisfy the preferences of different operators by adjusting rheostat 63 to vary the voltage dividing ratio of the voltage divider 62–64.

A selected one of the level setting currents is fed into the current summing node 47 during each printing cycle to control the impact energy imparted to the hammer 14. The class of the particular character to be printed is identified by the logic levels (i.e., 00, 01, 10 or 11) of a pair of bits which are applied to separate inputs of a decoder 75 which has another input coupled to receive the timing pulse B (FIG. 5) and further input coupled to a logic level supply source through a pull-up resistor 76. If the logic level supply source is at a high ("1") level and the timing pulse B is at a low ("0") logic level, the decoder 75 supplies a low ("0") logic level at one of its outputs while holding all of its other outputs at a high ("1") logic level. The outputs of the decoder 75 are coupled through inverters 77–80 to the respective common junctions of the weighting resistors and the buffering resistors of the different level setting circuits 43–46, respectively, Consequently, the logic levels of the character class identifying bits cause current to flow into the summing node 47 from a selected one of the level setting circuits 43–46.

As a practical matter, the operational amplifier 48 may tend to exhibit an undesirable output offset voltage. That offset voltage may, however, be readily nulled out by injecting a suitable compensating current into the current summing node 47. To accomplish that, there is a pair of resistors 81 and 82, which are connected in series between a supply source and the current summing node 47, and an inverter 83 which has its output coupled to a junction between the resistor 81 and 82 and its input coupled to receive the timing pulse B (FIG. 5). During each printing cycle the output of the inverter 83 goes to a high ("1") logic level, thereby permitting the desired compensating current to be drawn from the supply source through the resistors 81 and 82.

In keeping with another of the important features of this invention, provision is made for adaptively adjusting the resistance the hammer 14 encounters on its rebound or return stroke as a direct function of the impact energy imparted to the hammer 14 on its forward or printing stroke. To accomplish that, advantage is taken of the level setting circuits 43–46. Specifically, the energizing current for the electromagnet 35 is prolonged to ensure that the actuator arm 34 is still captured by the electromagnet 35 when the hammer 14 rebounds, but the amplitude of the energizing current is reduced to a predetermined fraction of the original set point value so that the actuator arm 34 tends to more or less smoothly absorb the rebound shock generated by the hammer 14. To carry that out, there is a transistor 84 which has its collector coupled through a load resistor 85 to a junction between the resistor 62 and the rheostat 63, its emitter returned to ground, and its base coupled by a current limiting resistor 86 to receive another timing pulse C. The timing pulse C goes to a high ("1") logic level to drive the transistor 84 into conduction during the rebound stroke of the hammer 14, but is otherwise maintained at a low ("0") logic level to hold the transistor 84 in a non-conductive state.

CONCLUSION

In view of the foregoing it will be appreciated that this invention provides a controller which may be used to advantage in electromagnetic hammer drivers for impact printers.

In closing it is noted that this application is directed to the provision made for adaptively absorbing the shock generated by the rebounding hammer, while a concurrently filed and commonly assigned U.S. Pat. application of David R. Deetz, Ser. No. 622,582 now abandoned in favor of continuation Ser. No. 767,714 is directed to the provision made for maintaining a substantially uniform print density.

What is claimed is:

1. In an impact printer having a hammer mounted for movement toward and away from a recording medium to print a selected character on said recording medium on a forward stroke and to rebound away from said recording medium on a rearward stroke, biasing means coupled to said hammer for biasing said hammer rearwardly away from said recording medium, electromagnetic driver means coupled to said hammer for propelling said hammer forwardly against said bias in response to an energizing current having a predetermined set point level to thereby impart impact energy to said hammer, and a controller for applying energizing current to said driver means on command; the improvement comprising control means coupled to said controller for reducing said energizing current to and for substantially maintaining said energizing current at a predetermined finite fraction of said set point level during the rearward stroke of said hammer, whereby said driver means smoothly absorbs shock forces generated by the rebounding hammer.

2. The improvement of claim 1 wherein said controller comprises means for changing said set point current level in preparation for printing different classes of characters, and means for selecting a definite set point current level in accordance with the class of each character to be printed; and said control means maintains the energizing current for said driver means at a substantially constant fraction of the selected set point current level during the rearward stroke of said hammer, regardless of the set point current level selected, whereby said driver means is adaptively adjusted to absorb the shock forces generated by the rebounding hammer.

3. The improvement of claim 1 wherein said controller comprises means for causing the energizing current for said driver means to decay from a high initial level toward said set point level as said hammer is being propelled forwardly.

4. The improvement of claim 3 wherein said controller additionally includes means for automatically adjusting said set point current level in preparation for printing different classes of characters, and said control means reduces the energizing current for said driver means during the rearward stroke of said hammer to a predetermined fraction of the adjusted set point current level, whereby said driver means has an adaptive shock absorbing capability.

5. The improvement of claim 1 wherein said controller includes a voltage divider having a midpoint, which is normally maintained at a first voltage level, a plurality of normally disabled weighted resistive networks coupled between said voltage divider midpoint and said driver means, and means for selectively enabling one of said networks in preparation for printing each character to establish said set point current level; and said control means includes means coupled to said voltage divider for temporarily reducing the voltage of the divider midpoint during the rearward stroke of said hammer, thereby adaptively adjusting said driver means to smoothly absorb the shock forces generated by the rebounding hammer.

6. The improvement of claim 5 wherein said controller further comprises an RC network coupled in parallel with said voltage divider and said resistive networks for causing said energizing current to decay from a high initial level toward the selected set point level with a predetermined time constant.

* * * * *